US005845581A

United States Patent [19]

Svensson

[11] Patent Number: 5,845,581

[45] Date of Patent: Dec. 8, 1998

[54] MONORAIL SYSTEM

[76] Inventor: Einar Svensson, 2248 NW. 190th Pl., Seattle, Wash. 98177

[21] Appl. No.: 646,198

[22] Filed: May 7, 1996

[51] Int. Cl.[6] ..... B61B 5/00

[52] U.S. Cl. ..... 104/120; 104/124; 104/130.11; 104/244; 104/243; 191/22 R; 105/145

[58] Field of Search ..... 104/124, 130.11, 104/242, 243, 244, 245, 246, 247, 118, 119, 120; 105/215.1, 141, 144, 145; 191/22 R

[56] References Cited

U.S. PATENT DOCUMENTS

| | | | |
|---|---|---|---|
| 2,670,994 | 3/1954 | Parrott | 301/39 |
| 2,853,956 | 9/1958 | Wenner-Gren et al. | 104/120 |
| 3,010,411 | 11/1961 | Peras | 104/247 |
| 3,095,828 | 7/1963 | Deller | 105/144 |
| 3,123,191 | 3/1964 | Sprigings | 191/58 |
| 3,198,139 | 8/1965 | Dark | 105/145 |
| 3,397,014 | 8/1968 | Nigrelli | 301/39 |
| 3,673,966 | 7/1972 | Wilson | 104/1 R |
| 3,710,727 | 1/1973 | Svensson | 104/124 |
| 3,823,672 | 7/1974 | Fellows et al. | 104/148 |
| 3,841,227 | 10/1974 | Fink | 104/148 SS |
| 3,847,086 | 11/1974 | Steenbeck | 104/130 |
| 3,847,088 | 11/1974 | Karch | 104/148 |
| 3,851,594 | 12/1974 | Schwarzler et al. | 104/148 MS |
| 3,861,320 | 1/1975 | Lichtenberg | 104/130 |
| 3,874,299 | 4/1975 | Silva et al. | 104/130 |
| 3,896,737 | 7/1975 | Miericke | 104/130 |
| 3,964,398 | 6/1976 | Breitling | 104/148 |
| 4,089,272 | 5/1978 | Schmitz | 104/247 |
| 4,090,452 | 5/1978 | Segar | 104/247 |
| 4,153,302 | 5/1979 | Bass et al. | 301/39 |
| 4,158,468 | 6/1979 | Bass et al. | 301/39 |
| 4,181,080 | 1/1980 | Miller | 104/148 MS |
| 4,194,603 | 3/1980 | Ross, Jr. | 191/23 |
| 4,232,611 | 11/1980 | Uozumi | 104/243 |
| 4,280,412 | 7/1981 | Mihirogi | 104/281 |
| 4,447,680 | 5/1984 | Segar et al. | 191/48 |
| 4,646,651 | 3/1987 | Yamamura et al. | 104/281 |
| 4,882,999 | 11/1989 | Azukizawa et al. | 104/281 |
| 4,996,928 | 3/1991 | Janssen et al. | 105/144 |
| 5,213,046 | 5/1993 | Proise | 104/281 |
| 5,215,015 | 6/1993 | Iida et al. | 104/23.1 |
| 5,247,890 | 9/1993 | Mihirogi | 104/130.11 |
| 5,445,080 | 8/1995 | Austin | 104/119 |

FOREIGN PATENT DOCUMENTS

| | | | |
|---|---|---|---|
| 550219 | 12/1957 | Canada . | |
| 1004084 | 1/1977 | Canada | 104/42 |
| 54-140311 | 10/1979 | Japan | 104/243 |
| 4-62201 | 2/1992 | Japan | 104/130.11 |
| 318969 | 8/1930 | United Kingdom | 104/247 |
| 1004952 | 9/1965 | United Kingdom . | |
| 2209318 | 10/1989 | United Kingdom | E01B 25/00 |

OTHER PUBLICATIONS

Thyssen Henschel, "Magnetic Leviation Technology Super Speed Maglev System Transrapid," 1993, 15 pgs., *Industrie AG Henschel*.

*Primary Examiner*—Mark T. Le
*Attorney, Agent, or Firm*—Klarquist Sparkman Campbell Leigh & Whinston, LLP

[57] ABSTRACT

A monorail system for passenger and light freight transportation provides a support structure with an essentially planar top surface and a stabilizer guide rail having a vertical web portion supporting an upwardly outwardly extending head. The head guides a vehicle along the top surface while conductors secured to the web portion transmit electrical current to the vehicle through a current collector secured to the vehicle. A portion of the stabilizer guide rail may be flexible providing a simple, inexpensive device for switching the vehicle between a plurality of tracks. The system operates equally well with a variety of vehicle propulsion and suspension systems including electro-mechanical, magnetic levitation or linear electric motors. In a preferred embodiment, the width of the support structure's top surface is approximately half the width of the vehicle, and the side of the web portion opposite the side having the conductor includes control conduits that transmit command signals to the vehicle through a communications connector secured to the vehicle.

40 Claims, 6 Drawing Sheets

FIG. 10
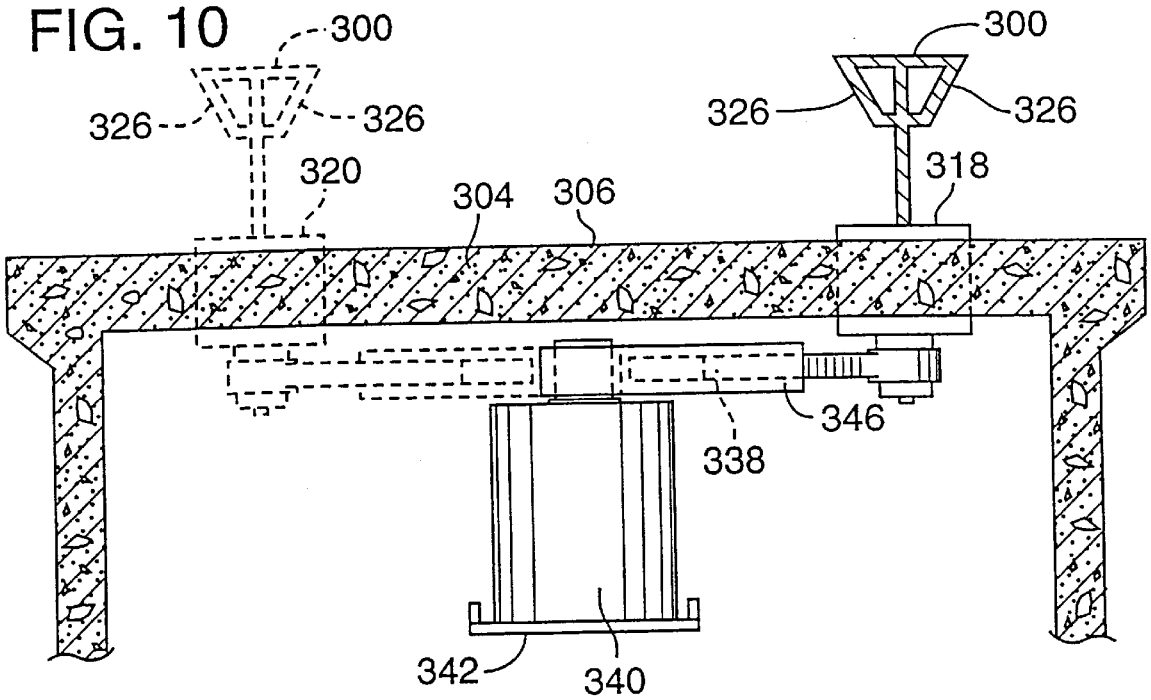
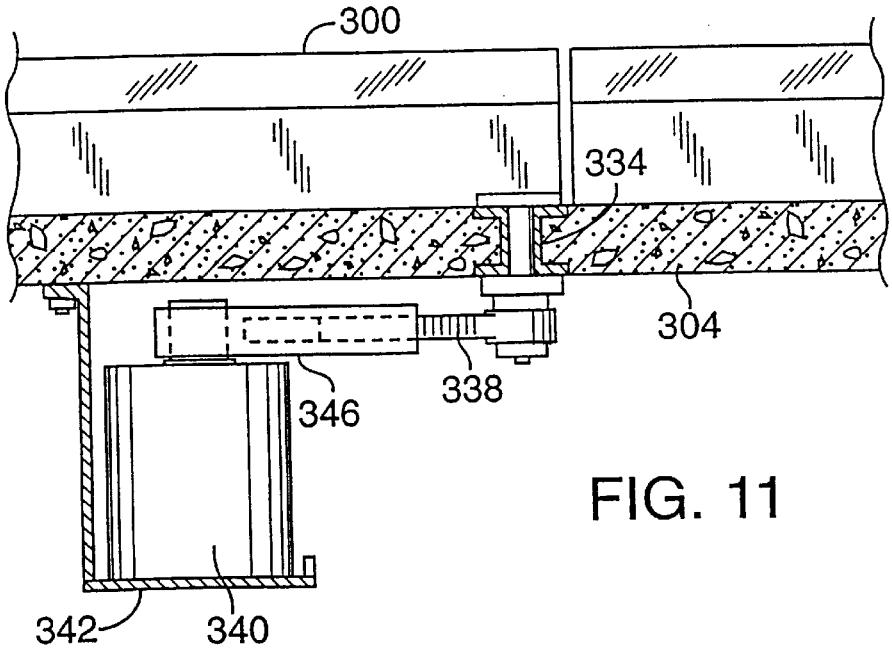
FIG. 11

MONORAIL SYSTEM

BACKGROUND OF THE INVENTION

The present invention relates to an improved monorail passenger and light freight system, including a vehicle and improved rail for such a system.

Over the years many monorail systems have been proposed. Most of those systems require wide, complicated runway structures and sophisticated equipment to guide, operate and switch the vehicles in the system. Consequently, the monorail systems were expensive and physically and aesthetically inappropriate in densely populated areas.

BRIEF SUMMARY OF THE INVENTION

Accordingly, an object of the present invention is to provide a monorail transportation system for passengers and light freight that is light and economical and enables free form construction at low cost.

Another object of the invention is to provide a monorail system with a low profile stabilizer guide rail that communicates with vehicles with independent bogies that have electro-mechanical propulsion and suspension systems, magnetic levitation systems, or linear electrical motor systems for propelling the vehicles.

A third object of the invention is to provide a monorail system with at least one longitudinal conductor mounted on and running parallel to the stabilizer guide rail and at least one electric cable received within and extending though the stabilizer guide rail to the longitudinal conductor.

A fourth object of the invention is to provide a means for receiving, within a vehicle in a monorail system, electrical information through a conductor.

Accordingly, the present invention provides an improved monorail system with an essentially planar top surface that includes (a) a means for support having an essentially planar top surface; (b) a longitudinal stabilizer guide rail with a vertical web supporting an upwardly and outwardly extending head forming two stabilizer guide tracks that is mounted parallel to and on top of the planar top surface and dividing the planar top surface into two parallel vehicle running paths; (c) at least one propelled vehicle having a vehicle body and at least two independent bogies in communication with the vehicle running paths and the stabilizer guide rail and the bogies being able to rotate independently about a pivot point between the vehicle body and the bogies; (d) at least one longitudinal conductor mounted on and running parallel to the stabilizer guide rail and one electric cable received within and extending through the stabilizer guide rail to the longitudinal conductor; (e) means for receiving electrical information in the vehicle through the longitudinal conductor.

BRIEF DESCRIPTION OF THE DRAWINGS

The features of this invention that are believed to be novel are set forth with particularity in the appended claims. The invention itself, however, together with its objects and the advantages thereof, will be best understood by reference to the following description taken in connection with the accompanying drawings in which:

FIG. 10 is an end sectional view of an embodiment of the switch having a crank motor and lever arm assembly along the line 10—10 in FIG. 9.

FIG. 11 is a side sectional view of an embodiment of the switch having a crank motor and lever arm assembly along the line 11—11 in FIG. 9.

DETAILED DESCRIPTION OF THE INVENTION

Figure 1:
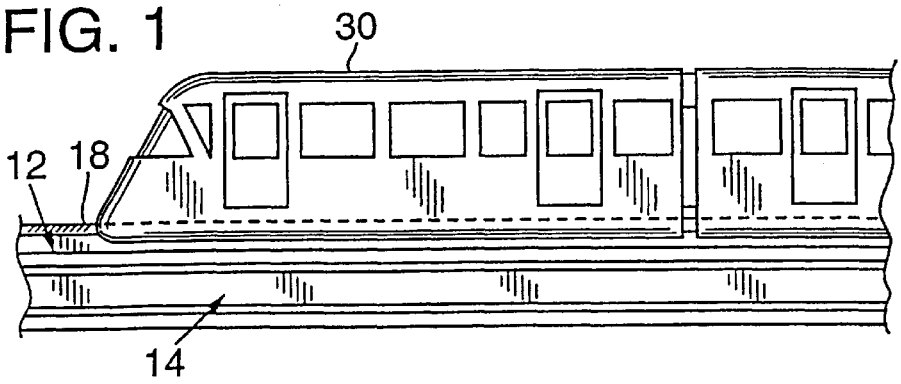
FIG. 1 is a sectional side view of a typical monorail system constructed according to the present invention including a vehicle running thereon.

Referring now to FIG. 1, the monorail system of the present invention includes a planar top surface 12 and one or more vehicles 30 running thereon. The planar top surface 12 may be the top of a concrete slab or more preferably a longitudinal beam 14. The concrete slab or longitudinal beam 14 may be a single continuous slab or beam or made up of a plurality of slabs or longitudinal beam sections (not shown) interconnected end to end by conventional means. The longitudinal beam 14 in cross section may be an inverted "U"-shape or a hollow rectangle or trapezoid, or any other hollow configuration providing a planar top surface 12. The instant invention may be adapted for use in a tunnel or subway setting, at ground level, or an elevated beamway above ground by support columns using conventional techniques or supported as disclosed in U.S. Pat. No 3,710,727.

Figure 3:
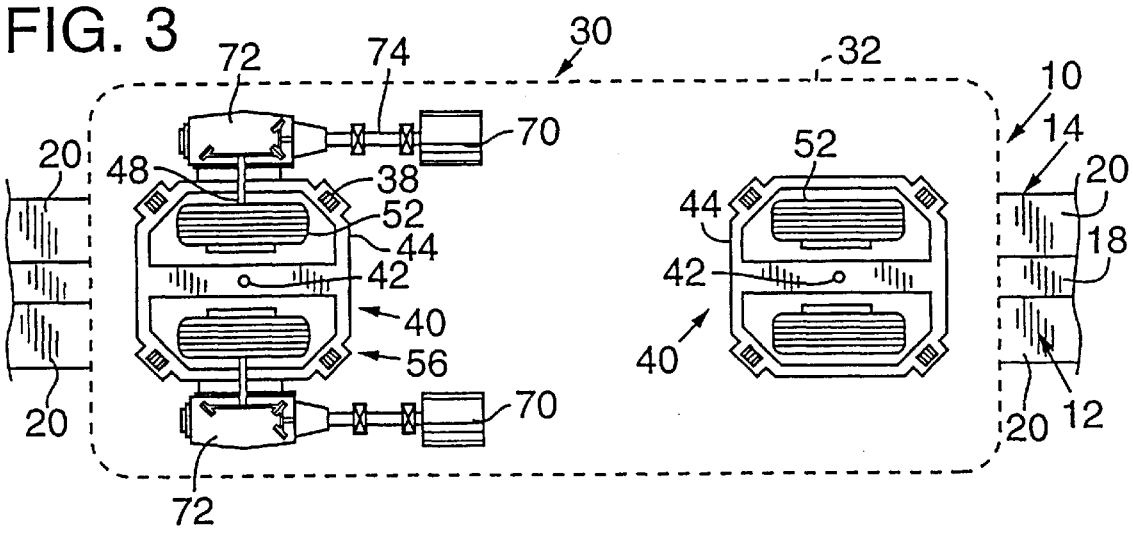
FIG. 3 is a schematic sectional plan view of the planar top surface and stabilizer guide rail with an alternative wheeled vehicle running thereon.
Figure 2:
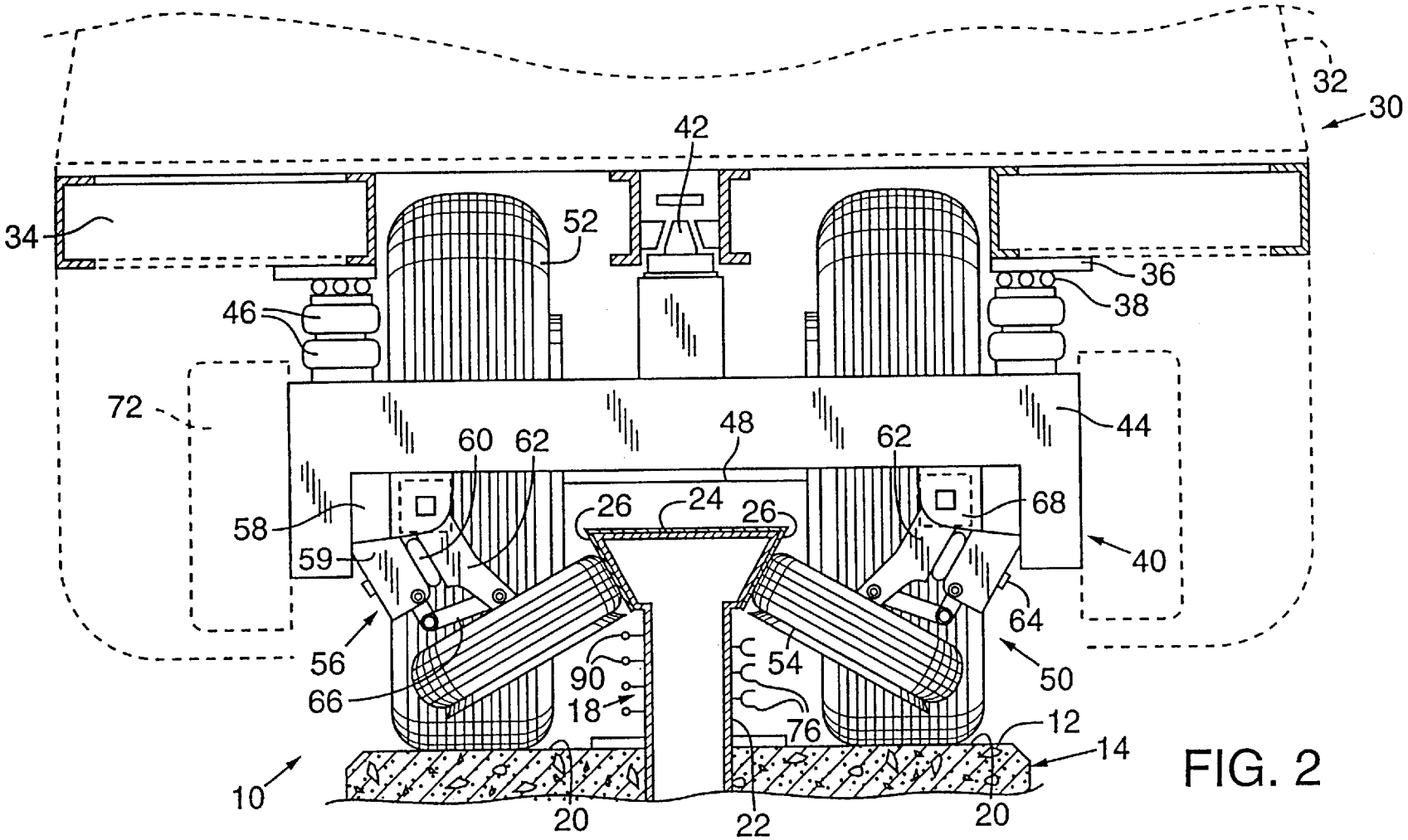
FIG. 2 is a partial schematic sectional end view of the planar top surface and stabilizer guide rail with a wheeled vehicle running thereon.

Mounted on top of and parallel to the planar top surface 12 is a stabilizer guide rail 18. As shown in FIGS. 2 and 3, the stabilizer guide rail 18 divides said planar top surface 12 into two parallel vehicle running paths 20. The stabilizer guide rail 18 may be made of either rigid or flexible materials except in the areas where the stabilizer guide rail 18 must be made of a flexible material to enable moving the stabilizer guide rail 18 from one planar top surface 12 to another planar top surface 12 as will be described below. Accordingly, the stabilizer guide rail 18 may be made of concrete, steel, aluminum, reinforced fiberglass, hard plastics or other suitable materials. If the stabilizer guide rail 18 is made of concrete, a metal or hard non-metallic cap (not shown) may be fitted on its head to reduce wear or cracking caused by vehicles running thereon as will be described hereafter.

Figure 4:
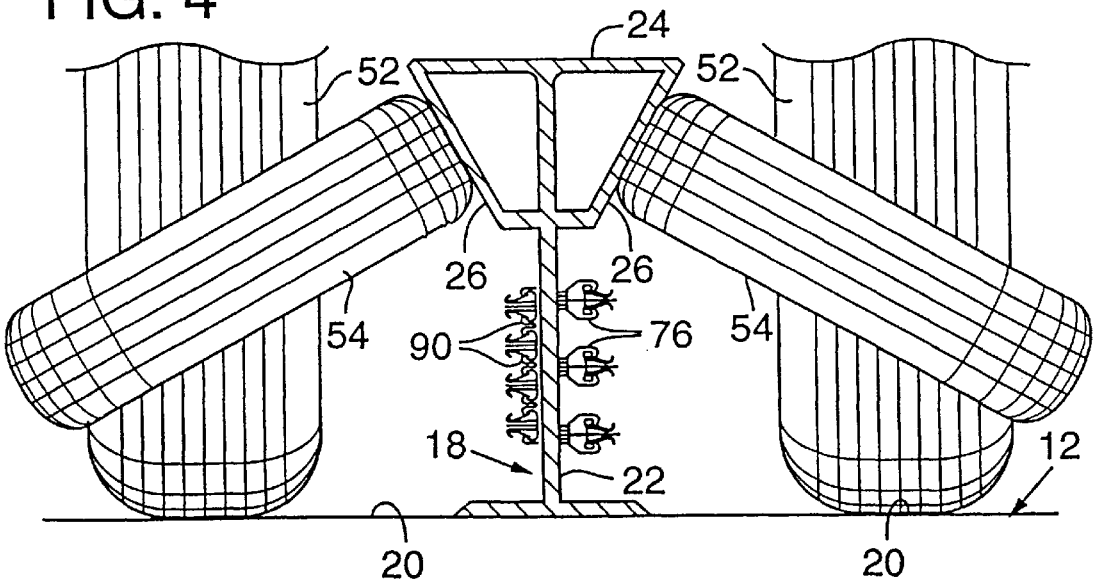
FIG. 4 is an enlarged partial schematic sectional end view of the planar top surface and stabilizer guide rail showing the control conduits and insulated contact rails in greater detail.

As shown in FIG. 2, the stabilizer guide rail 18 includes a vertical web 22 supporting an upwardly and outwardly extending head 24 forming two stabilizer guide tracks 26. The vertical web 22 and head 24 may be hollow as shown in FIG. 2 or a modified I-beam as shown in FIG. 4.

The planar top surface 12 is approximately four feet wide for a full-scale system and is not more than half of the width of a full-size vehicle 30. The width of the planar top surface 12 will be smaller if the monorail system 10, including the vehicles 30, are constructed on a smaller scale.

As shown in FIGS. 2 and 3, the vehicle 30 consists of a vehicle body 32 and at least one bogie 40. Each bogie 40 includes a vertical and horizontal pivot point 42 and bogie frame 44. The vehicle 30 will have one of three propulsion systems (i.e., electro-mechanical power, magnetic levitation, or linear electrical motors) , each of which will be discussed below. In each case, the vehicle body 32 rests on top of the bogie frames 44 through the suspension systems 46, allowing the bogies 40 to rotate independently of each other and the vehicle body 32 about a pivot 42. Preferably, the vehicle body 32 includes a vehicle chassis 34 with slots (not shown) for receiving the pivot point 42 for each bogie 40. The pivot point 42 is a shear pin.

As shown in FIG. 2, the chassis 34 also rests on a ring-shaped turn table 36, which communicates with the bogie frame 44 via rollers 38 and thereby provides added horizontal stability. The vehicle chassis 34 and bogie frames 44 may be made of steel, aluminum or fiberglass materials.

The primary suspension system for the vehicle 30 is provided in conjunction with the propulsion systems described below. A secondary vertical suspension may be provided by one or more pairs of vertical springs with lateral restraining 46 to keep the vehicle floor at the same level for different passenger or cargo loadings. The vertical springs 46 are located between the rollers 38 and the bogie frame 44. Preferably, the vertical springs 46 are automatic leveling and self-inflating air springs.

ELECTRO-MECHANICAL PROPULSION AND SUSPENSION SYSTEM

One embodiment of the instant invention includes one or more electric powered bogies 40 with wheels. As shown in FIG. 2, each bogie 40 may include an axle 48 attached to the bogie frame 44 and positioned substantially perpendicular to the vehicle running paths 20. A drive wheel assembly 50 having one or more pairs of drive wheels 52 are attached to the axle 48. Alternatively, as shown in FIG. 3, each bogie 40 may include two axles 48 attached to the bogie frame 44 and positioned substantially perpendicular to the parallel vehicle running paths 20. One or more drive wheels 52 are attached to each axle 48. In both FIGS. 2 and 3, the drive wheels 52 are located inside the bogie frame 44 and adapted to run on the vehicle running paths 20. These drive wheels 52 may be solid, gas-filled, air-filled, or more preferably foam-filled rubber or synthetic rubber.

On a vehicle 30 longer than 12 feet, all electro-mechanical driven bogies 40 should include at least a first and second pair of guide wheels 54 separated by the drive wheels 52. On a vehicle 30 less than 12 feet long, only a single pair of guide wheels 54 need be associated with each set of drive wheels 52.

Each pair of guide wheels 54 straddles the stabilizer guide rail 18. Each individual guide wheel 54 is attached to the bogie frame 44 by a linkage 56 and is inclined to run along one stabilizer guide track 26. Preferably, the linkage 56 is a lateral suspension linkage that includes the following components shown in FIG. 2: a fixed bracket consisting of two spaced-apart plates 58 and 59 that are welded to the bogie frame 44 with a tube-shaped extension protruded down and in toward the stabilizer guide rail 18 about 30°±5°, an adjustment lever 62 connected by bolts to the fixed bracket plates 58 and 59 at one end of the adjustment lever 62 and to a guide wheel 54 at the other end of the lever 62, a controlled spring 60 between the fixed bracket plate 58 and the adjustment lever 62, a manual spring adjustment 64 controlling the spring 60 and adjustment lever 62, an automatic adjustment lever 66, and a vibration damper 68.

The spring 60 is preferably a controlled air pressure spring. Using the manual spring adjustment 64, one can tighten or loosen the spring 60 to adjust the amount of pressure the adjustable lever 62 causes the guide wheel 54 to exert against the stabilizer guide track 26. By releasing the spring 60 and the bolts between the adjustment lever 62 and the stabilizer guide wheel 54, the stabilizer guide wheel 54 can be rotated away from the stabilizer guide rail 18 and serviced. The automatic adjustment lever 66 adjusts for horizontal movement of the stabilizer guide wheel 54 as it moves in and out of curves in the stabilizer guide track 26 and stabilizes the linkage 56.

The spring-induced pressure of the guide wheels 54 against the inclined stabilizer guide track 26 minimizes the risk of overturning the vehicle 30, notwithstanding the centrifugal forces and wind that act upwardly on the cars during motion. The guide wheels 54 pressing against the inclined stabilizer guide track 26 generate a vertical force component that biases the drive wheels 52 downward for improved traction between the drive wheels 52 and the vehicle running paths 20. The guide wheels 54 steer the vehicle 30 by causing a small rotation of the bogie 40, which takes place independently of the vehicle body 32.

The vibration damper 68 is a pad or cushion around the bolt connecting the fixed bracket plates 58 and 59 to the lever 62. Preferably, the vibration damper 68 is a cube-shaped rubber cushion that is fixed between the bracket plates 58 and 59 and dampens vibration.

In this embodiment of the instant invention, the vehicle is propelled forward by one or more electric traction motors 70 and preferably operates on alternating current. In some instances, traction motors 70 will be fixed to only one of the bogies 40, usually the rear bogie 40. For large vehicles, traction motors 70 will be fixed to each of the bogies 40. If a single axle 48 is used in conjunction with the drive wheels 52 on a bogie 40, a single electric traction motor 70 may be fixed to said bogie frame 44 and communicate with said axle 48 through a gear mechanism 72. If as shown in FIG. 3, each bogie 40 includes two axles 48 attached to the bogie frame 44, two electric traction motors 70 may be fixed to the bogie frame 44 so that one motor 70 communicates with one axle 48 through a gear mechanism 72. Alternatively, an expandable drive shaft 74 may be coupled to and between each said gear mechanism 72 and each said electric traction motor 70 to enable attachment of the electric traction motor 70 to the vehicle floor frame 34 instead of the bogie frame 44. The motor could, however, be supported by the bogie mounted to the outside of the bogie frame.

Power for the electric traction motors 70 is obtained through electrical cables received within and extending though the stabilizer guide rail 18. These cables are connected to insulated contact rails 76 on the stabilizer guide rail 18. The conductive portion of the insulated contact rail 76 may be made of copper, aluminum, or any other suitable conductive material. Two insulated contact rails 76 are mounted on the stabilizer guide rail 18 if two-phase power is desired and three insulated contact rails 76 are mounted if three-phase power is desired. The use of insulated contact rails 76, instead of bare contact rails, enables closer spacing of the contact rails 76, results in a shorter stabilizer guide rail 18 (about 360 mm for the combined height of the head 24 and web 22), and increases safety of the monorail system 10 operation.

Figure 5:
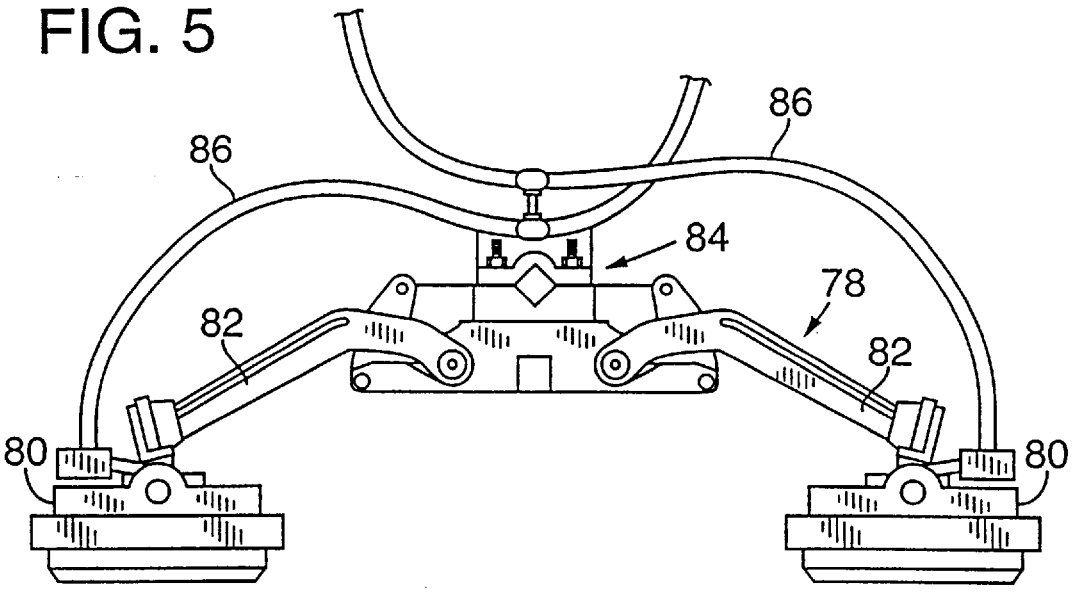
FIG. 5 is a top plan view of the double current collector of a preferred embodiment of the present invention.

The power is picked up by current collectors 78 installed on the bogie frame 44 or vehicle floor frame 34. Preferably, the current collectors 78 are double current collectors shown in FIG. 5. More specifically. FIG. 5 is a top view of the double current collector 78 with a first and second collector heads 80, first and second collector pivot levers 82, collector mounting bracket 84, and first and second collector cables 86.

Figure 6:
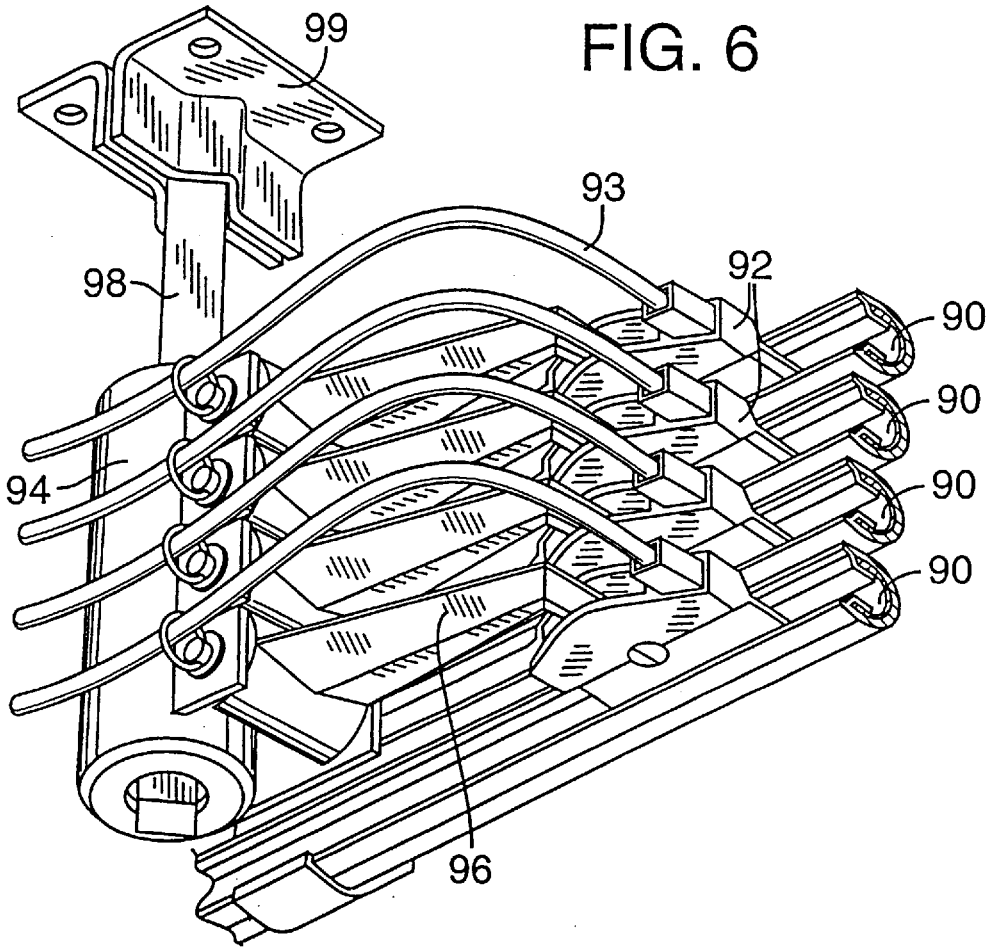
FIG. 6 is a partial schematic view of a guideway inductive communications collector in accordance with the preferred embodiment of the present invention.

A vehicle control and communication system (VCCS) consists of printed circuit assemblies that respond to guideway-inductive communications to regulate vehicle position and generated control functions for the vehicle 30. This would, for example, apply to brakes, motor propulsion demands, power loss, speed, temperature, and exit door closing. The VCCS is channeled through control conduits 90 mounted on the stabilizer guide rail 18. Preferably, the control conduits 90 are insulated and mounted on the opposite side of the stabilizer guide rail 18 from the insulated contact rails 76. As shown in FIG. 6, guideway inductive communications are picked up from the control conduits 90 by guideway-inductive communica ion collectors 92 and communication cables 93. The communication collectors 92 are attached to a communication collector hub 94 by collector arms 96. The communication collector hub 94 is mounted on the bogie frame 44 or vehicle floor frame 34 by mounting arm 98 and bracket 99.

Alternatively an antenna and radio receiver may be used to replace the guideway inductive communication collectors 92, collector hub 94, collector arms 96, mounting arm 98 and bracket 99.

Brakes (not shown) for the vehicles with electro-mechanical bogies 40 are mechanical brakes and dynamic brakes. The mechanical brakes are friction drum brakes or dual-piston caliper, electropneumatically operated. The mechanical brakes work in combination with the dynamic brakes in decelerating the vehicle from about 5 miles per hour to a full stop. Emergency braking is controlled by a pneumatic spring valve held off the friction brakes.

MAGNETIC LEVITATION SYSTEM

Figure 7:
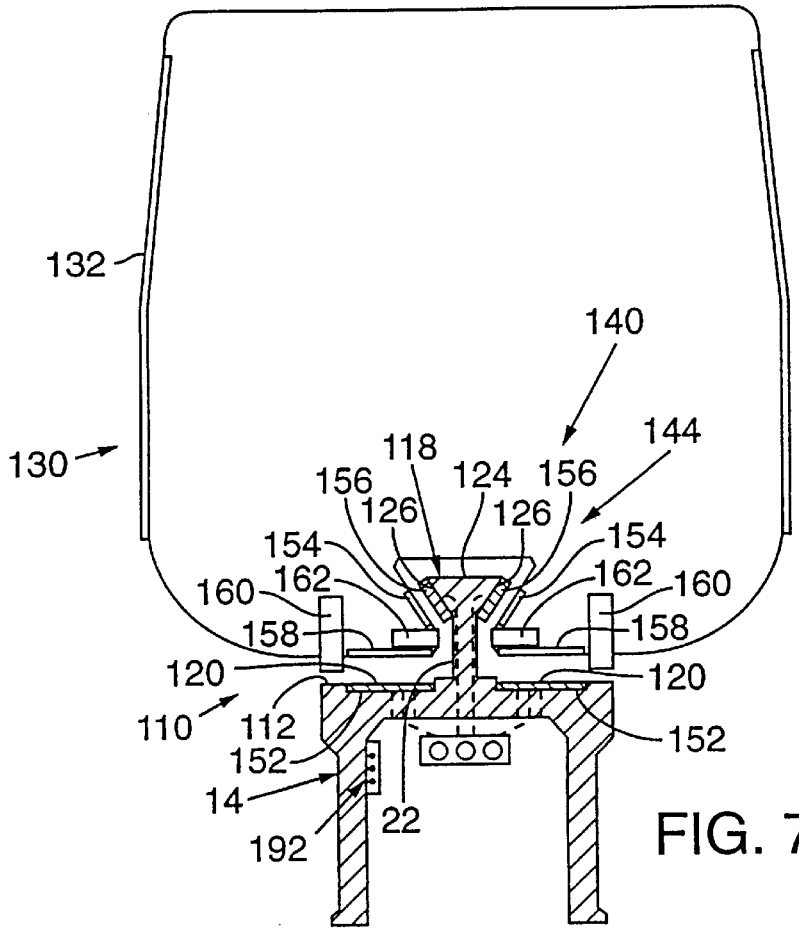
FIG. 7 is a partial schematic sectional end view of the planar top surface and stabilizer guide rail with a magnetically levitated and propelled vehicle running thereon.

A second embodiment of the instant invention involves the use of magnetically levitated and propelled bogies 140. Referring now to FIG. 7, the monorail system 110 also may be adapted to operate with magnetic levitation and propulsion ("Maglev Technology"). The general concept of levitating and propelling objects are known but have not been applied to monorails. For example, see U.S. Pat. No. 3,841,227.

Maglev Technology of the instant invention involves the use of a plurality of magnets in a vehicle 130, vehicle running paths 120 and stabilizer guide rail 118 in such a manner that during operation of the vehicle 130 there is no physical contact between the vehicle 130, the vehicle running paths 120 and the stabilizer guide rail 118.

There are two basic types of magnets in this second embodiment of the monorail system:

1. Stationary magnets 152 and 156, installed and recessed into the planar top surface 112 of the parallel vehicle running paths 120, and along the two stabilizer guide tracks 126 of the stabilizer guide rail 118; and
2. Travelling magnets 154 and 158 installed in the bogie frame 144 of the vehicle 130.

The stationary magnets 152 and 156 and travelling magnets 154 and 158 are aligned so that they repel each other during operation of the vehicle 130. Both the stationary and travelling magnets are coils of conductive material such as aluminum, titanium, copper, or combinations of titanium and aluminum.

The bogies of the electro-mechanical embodiment described above may be modified to accommodate the Maglev Technology. Drawing part numbers 10 through 44 of FIGS. 1 through 4 correspond to drawing part numbers 110 through 144 of FIG. 7.

Stabilization, steering, and control of the vehicle 130 are accomplished by having at least a first and second traveling guide magnet 154 within each bogie 140 and positioned on opposite vertical sides of the stabilizer guide rail 118 straddled by the bogie frame. These travelling guide magnets 154 operate in conjunction with repulsive stationary magnets 156 received along the stabilizer guide tracks 126 of the stabilizer guide rail 118. Collectively these travelling and stationary guide magnets 154 and 156 perform the same function as the guide wheels of the electro-mechanical embodiment, but without any component of the vehicle 130 ever directly contacting the stabilizer guide rail 118 during cruise operations.

Preferably, each travelling guide magnet 154 is attached to the bogie frame 144 through a linkage in a manner similar to the electro-mechanical embodiment; however, each travelling guide magnet 154 may be mounted directly to the bogie frame 144 provided the traveling guide magnet 154 is aligned with its adjacent stationary guide magnets 156. In addition, optimal performance and economy is obtained by providing one first and one second travelling guide magnet 154 per bogie frame 144; however, the vehicle 130 will operate effectively with additional travelling guide magnets 154 within each bogie frame 144.

An air gap between each travelling guide magnet 154 and its corresponding stationary guide magnets 156 may vary greatly between installations without adversely impacting the operation of the vehicle 130. Optimal performance for the monorail is obtained when this distance between the travelling guide magnets 154 and the stationary guide magnets 156 is 5 centimeters.

Levitation of the vehicle 130 is obtained in a similar fashion. For optimal performance, at least two traveling drive magnets 158 are mounted within each bogie frame 144 above the area to be occupied by the two parallel vehicle running paths 120. A plurality of stationary drive magnets 152, aligned to provide repulsive force to the corresponding travelling drive magnets 158, are mounted along the vehicle running paths 120. Collectively these travelling and stationary drive magnets 152 and 158 perform the same function as the drive wheel assembly of the electro-mechanical embodiment, but without any component of the vehicle 130 directly contacting the stabilizer guide rail 118 during cruise operation of the vehicle 130. Propulsion and braking of the vehicle 130 is accomplished by modulating the repulsive forces of the stationary and travelling drive magnets 156 and 158 using conventional techniques.

The pattern and size of the stationary magnets 152 and 156 can be designed and engineered for maximum power efficiency. For example, the pattern of these magnets can be "figure 8" shaped, and known as "null-flux" coils of titanium, aluminum, copper, or other conductive materials mounted in the vehicle running paths 120 on each side of the stabilizer guide rail and cross connected. In this configuration, the rectangular shaped travelling drive magnets 158 within each bogie frame would include four super conducting magnets to interact with the "null-flux" coils to generate propulsion, levitation, and guidance.

During initial start-up or during an emergency operation of the maglev system, the repulsive forces between the corresponding stationary and travelling drive magnets 152 and 158 and travelling and stationary guide magnets 154 and 156 may not be sufficient to levitate or steer the vehicle 130. Because of these situations, it may be desirable to incorporate emergency drive wheels 160 and emergency guide wheels 162 to prevent damage to the vehicle 130, stabilizer guide rail 118, bogies frames, or other components. It is preferable that these emergency drive wheels 160 and emergency guide wheels 162 are made of steel, or other rigid metal or alloy, are mounted on retractable axles (not shown), and have a diameter large enough to provide clearance between the stabilizer guide rail head 124 and the vehicle body 132. Alternatively, the emergency guide wheels 160 and emergency drive wheels 162 may be mounted and operated in a manner similar to the electro-mechanical embodiment.

The air gap between each travelling drive magnet 158 and its corresponding stationary drive magnets 152 may vary greatly between installations without adversely impacting the operation of the vehicle 130. Optimal performance for the monorail system is obtained when the drive magnets and tolerances are sized to obtain a 6 centimeter distance between these magnets during normal cruise operation.

The size of the stationary and travelling guide magnets 154 and 156 and stationary and travelling drive magnets 152 and 158 depends on the size,-weight, and expected load requirements of the vehicle. In general, the drive magnets 152 and 158 should be able to create repulsive forces totalling twice the expected combined maximum load and weight of the vehicle 130. The guide magnets 154 and 156 should be able to create repulsive forces totalling twice the maximum expected lateral, centrifugal, and wind forces acting on the vehicle 130.

In order to optimize the required electromagnetic repulsive forces, the planar top surface 112 and stabilizer guide rail 118 should be constructed with suitable non-magnetic material. The preferred material for the planar top surface 112 is concrete, however, suitable non-magnetic materials should be substituted for the steel and steel pre-stressing wires commonly used inside a concrete structure. The stabilizer guide rail 118 may be made from a variety of non-magnetic materials including, but not limited to, concrete and reinforced plastic.

Power to the travelling magnets 154 and 158 and vehicle 130 may be provided by a variety of methods. For example, similar to the electro-mechanical embodiment discussed above, insulated conductors may be mounted on the longitudinal stabilizer guide rail 118. However, because of the tight tolerances between the travelling magnets 154 and 158 and stationary magnets 152 and 156, the conductors may be mounted on the top of the stabilizer guide rail 118. Moreover, to help reduce electromagnetic interference between the travelling magnets 154 and 158 and stationary magnets 152 and 156, it is preferred that the conductors be electro-magnetic. Power could also be provided to the vehicle 130 by batteries mounted within the vehicle 130.

Similarly, control commands may be transmitted to the vehicle 130 by a variety of methods. For example, similar to the electro-magnetic conductors providing power to the vehicle 130, control commands may be transmitted to the vehicle through a separate set of electro-magnetic conductors mounted on the top of the stabilizer guide rail 118. Alternatively, an inductive control system 192, may be similar to the vehicle control and communication system (VCCS) using an antenna described in the electro-mechanical embodiment may be implemented.

All power cables and control system 192 needed for the stationary magnets in the vehicle running paths 120 and the stabilizer guide rail 118 may be channeled up from below the vehicle running path 120 through the hollow web of the stabilizer guide rail 118 to the magnets.

LINEAR INDUCTION MOTOR SYSTEM

Figure 8:
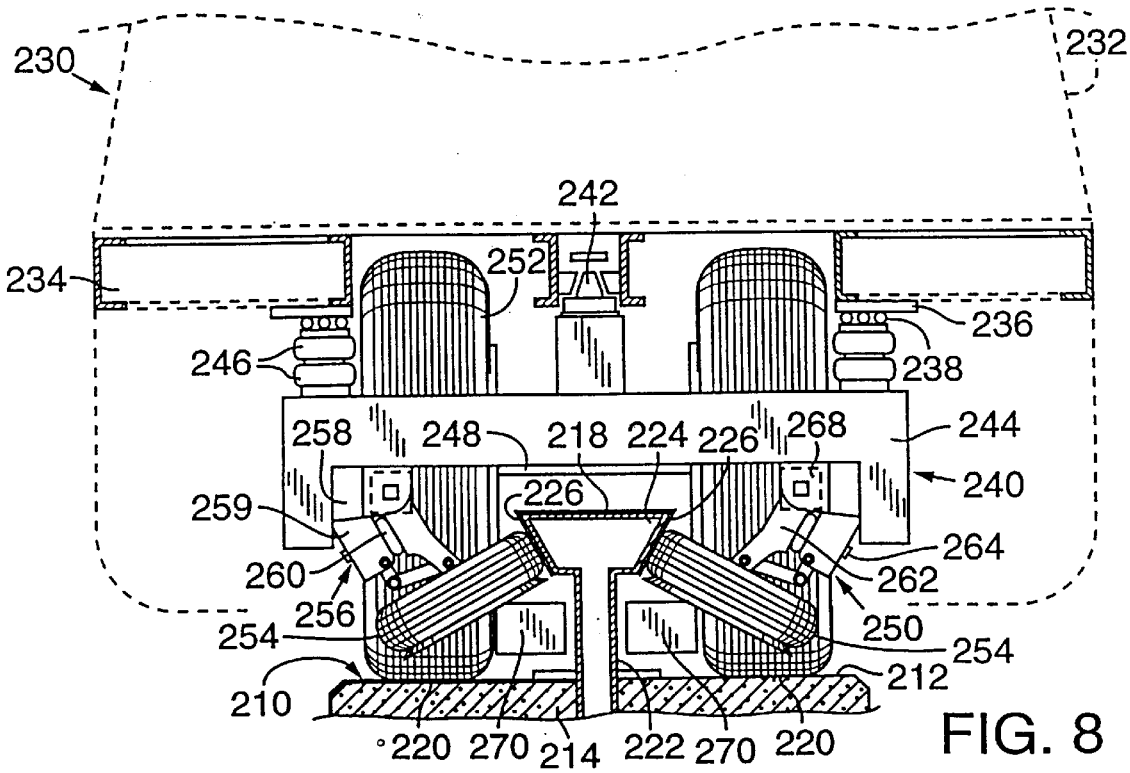
FIG. 8 is a partial schematic sectional end view of the planar top surface and stabilizer guide rail with a linear electrical motor propelled vehicle running thereon.

A third embodiment of the instant invention involves the use of linear electrical motor systems. See FIG. 8. Referring now to FIG. 8, another embodiment of the invention includes the application of a linear electric motor 270 received within the bogie frame 244 to propel the vehicle 230. In this embodiment, a linear electric motor 270 is substituted for the electrical traction motor of the electro-mechanical embodiment shown in FIGS. 1–4.

The bogies of the electro-mechanical embodiment described above may be modified to accommodate the linear electric motor 270. Drawing part numbers 10 through 66 of FIGS. 1 through 4 correspond to drawing part numbers 210 through 266 of FIG. 8.

A linear electric motor 270 is perhaps best understood by imagining the stator of an ordinary electrical motor being cut, unrolled and stretched lengthwise. An appropriate conductive material like copper, aluminum, or other material is positioned next to the unrolled stator. The alternating current in the unrolled stator provided by conventional techniques magnetically interacts with the conductive material to create a moving field of magnetic force acting on both the stator and the conductive material. The vehicle may be slowed down or stopped by reversing the polarity of that moving field.

By positioning a linear electric motor 270 on the vehicle 230 adjacent to a conductive material received along the web 222 of the longitudinal stabilizer guide rail 218, the vehicle can be propelled along the vehicle running paths 220. In this embodiment, the linear induction motor 270 may be on either side of the longitudinal stabilizer guide rail 218, or one linear induction motor 270 may be placed on each side of the longitudinal stabilizer guide rail 218.

Alternatively, a series of linear electric motors may be mounted along the web 222 and conductive material mounted on the bogie 240 or bogie frame 244 adjacent to the web 222. In situations where a linear electric motor 270 is mounted to the web 222, the longitudinal stabilizer guide rail 218 and the planar top surface 210 may be made of reinforced plastic, fiber glass, or other suitable non-conductive material.

For optimal performance, the distance between the linear electric motor 270 and conductive material mounted on the bogie 240 or bogie frame 244 should be not more than one half an inch.

In situations where it is desirable to install the linear electric motor 270 within the bogie, the linear electric motor 270 may be sized to fit below and between the lateral suspension linkage 256 and adjacent to the web 222. The linear electric motor 270 also may be attached to the bogie frame 244 though mounting brackets (not shown).

Power to the linear electric motor 270 may be provided by a variety of techniques. In situations where there is only one linear electric motor 270 adjacent to the longitudinal stabilizer guide rail 218, insulated power and control conductors may be positioned on the opposite side of the web 222 containing the required conductive material. Alternatively, if a linear electric motor 270 is installed on each side of the longitudinal stabilizer guide rail 218, insulated power and control conductors may be positioned along the top of the longitudinal stabilizer guide rail head 224. In addition, a longitudinal stabilizer guide rail 218 having an open web 222 may be used. In that case, insulated power and control conductors may be positioned along the vehicle running path 220. Also, power to the linear electric motor 270 and other ancillary electrical components may be provided by rechargeable batteries (not shown) positioned within the vehicle 230.

One skilled in the art will readily see that it is possible to combine technologies such that a vehicle can be propelled by a linear electric motor installed along the stabilizer guide rail and magnetically levitated by magnets installed in the running path and along the stabilizer guide tracks.

VEHICLE PATHWAY SWITCH

Figure 9:
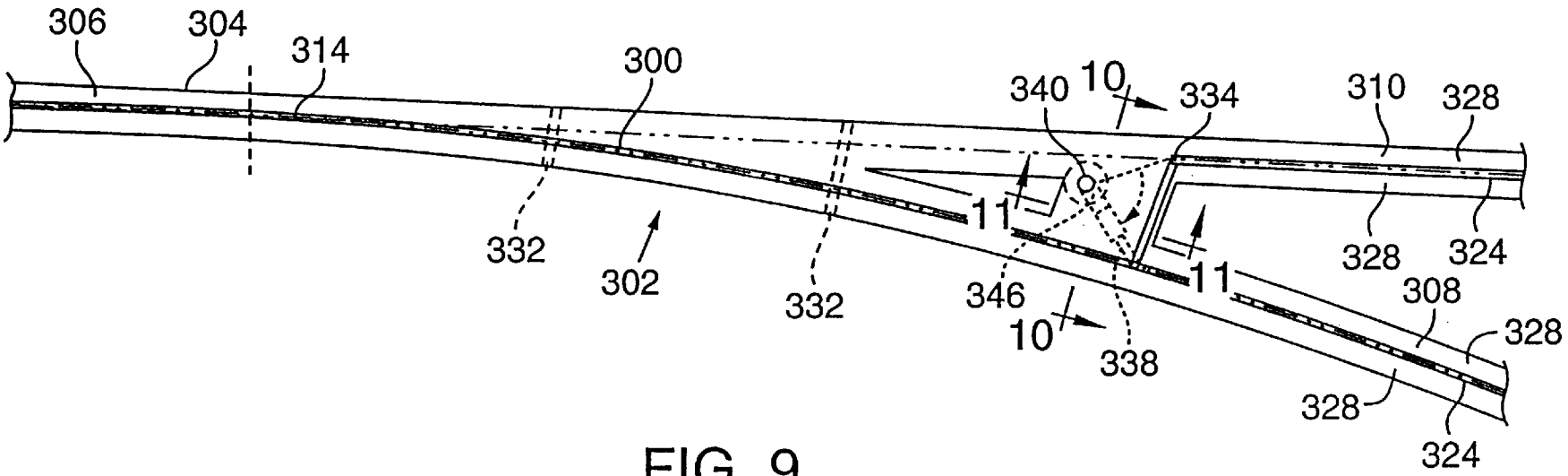
FIG. 9 is a plan view of one embodiment of a switch made according to the present invention including the flexible stabilizer guide rail shown in the switched position.

Another improvement of the invention involves the ability to easily switch the vehicle 330 between two or more vehicle running paths 328. FIGS. 9, 10, & 11. The present invention permits a vehicle to be switched from one planar top running surface 306 to another simply by pivoting a flexible stabilizer guide rail 300 of predetermined length between two planar top surfaces 306 and 310. The switch itself may be constructed and supported using traditional methods, materials, or techniques disclosed in U.S. Pat. No. 3,710,727.

Referring now to FIG. 9, an improved pathway switch 302 is disclosed. The system includes an essentially Y-shaped vehicle pathway 304 having an essentially planar top surface 306. The Y-shaped vehicle pathway 304 is joined at its foot to a single planar top surface 306 and at its arms to a second planar top surface 308 and a third planar top surface 310, respectively. A flexible stabilizer guide rail 300 has one end fixedly mounted near the foot or base of the Y-shaped vehicle pathway 304 by, for example, pins, while its other end is movable between the arms of the Y-shaped vehicle pathway 304. FIG. 10 shows the flexible stabilizer guide rail 300 in its first position 318 and second position 320, respectively.

The flexible stabilizer guide rail 300 may be made of steel, aluminum or plastic reinforced fiberglass or other suitable material so long as the material is flexible in the transverse direction and has strength sufficient to withstand the forces exerted thereon by the passing vehicle. The length of the flexible stabilizer guide rail 300 vary with the design speed of the vehicle. Thus, at higher speeds, a longer flexible stabilizer guide rail 300 is needed. For example, while the vehicle is in the maintenance yard and operated at slow speeds, the switch may be only twenty five feet long.

The flexible stabilizer guide rail 300 has at least one electric cable received within it providing power to at least one continuous longitudinal insulated conductor mounted to the flexible stabilizer guide rail 300. The flexible stabilizer guide rail 300 is electrically connected to continuous longitudinal insulated conductor mounted to the flexible stabilizer guide rail 300 at the foot of the Y-shaped vehicle pathway 304.

Each arm of the Y-shaped vehicle pathway 304 includes a stabilizer guide rail 324 having a vertical web (not shown) supporting an upwardly and outwardly extending head (not shown) forming two stabilizer guide tracks 326. Each stabilizer guide rail 324 is mounted parallel to and on top of the Y-shaped vehicle pathway 304 dividing the planar top surface into two parallel vehicle running paths 328. Both stabilizer guide rails 324 in the arms of the Y-shaped vehicle pathway 304 have at least one insulated electrical contact at or near their ends closest to the foot of the Y-shaped vehicle pathway 304. Each stabilizer guide 324 rail has at least one electric cable received within it providing power to at least one continuous longitudinal insulated conductor mounted to the stabilizer guide rail 324.

For each finally commanded position of the flexible stabilizer guide rail 300, at least one electrical contact at the moving end of the flexible stabilizer guide rail 300 aligns a corresponding contact on the stabilizer guide rail 324 in one of the arms of the Y-shaped vehicle pathway 304 to close the electrical circuit. This alignment permits a continuous insulated conductor along the path of the vehicle through the pathway switch.

It is envisioned that this technique of providing continuous electrical connections to the vehicle 330 through the switch also may be used to provide operation and control signals discussed above in the description of other embodiments. Moreover, the switch components may be made from suitable non-conducting or non-magnetic materials as required to permit any of the previously discussed embodiments to effectively operate thereon.

FIGS. 9, 10 and 11 disclose one embodiment of a switch for moving one end of the flexible stabilizer guide rail 300 between the arms of the Y-shaped vehicle pathway 304. The flexible stabilizer guide rail 300 has a guide foot adapted to be movably inserted in at least one guide slot 332 in the Y-shaped vehicle pathway 304. The guide slot 332 runs between the diverging arms of the Y-shaped vehicle pathway 300 and may be supported by braces or simply cut into the Y-shaped vehicle pathway 304. Preferably, the guide slot 332 and guide foot are either greased metal or plastic to aid passage the guide foot along the guide slot 332.

A drive slot 334 running through the Y-shaped vehicle pathway 304 between the diverging arms of the Y-shaped vehicle pathway 304 aids moving the end of the flexible stabilizer guide rail 300. The movable end of the flexible stabilizer guide rail 300 has a drive foot that is movably received within the drive slot 334. Preferably, the drive slot 334 and drive foot may be either greased metal or plastic to allow easy passage of the drive foot along the drive slot 334. The drive slot has a narrow opening that extends through the bottom of the Y-shaped vehicle pathway 304. A lever arm 338 is pivotally attached to the drive foot though the narrow opening on the bottom of the Y-shaped vehicle pathway 304.

A crank motor 340 is attached below the Y-shaped vehicle pathway 304 with a support bracket 342. An expandable lever arm 346 is pivotally attached to the crank motor 340 and linked to the lever arm 338 such that operation of the crank motor 340 drives both the expandable lever arm 346 and lever arm 338 and thereby moves the flexible stabilizer guide rail 300 between its first position on one arm and its second position on the other arm of the Y-shaped vehicle pathway 304.

Other means such as driven rollers connected directly to the flexible stabilizer guide rail 300 or a hydraulic cylinder and piston arrangement, or pulleys and pulley drive motor may also be used to deflect the flexible stabilizer guide rail 300.

The monorail system of the present invention can be built to different scales of size. The "full scale" system is applicable to trunklines and commuter vehicles (trains) with potential large volumes of passenger traffic per hour. It also can be used for transporting light freight. Vehicles for the "full scale" system may be, for example, 30 feet long, 10 feet wide and approximately 10 feet tall when measured from the top of the vehicle running path to the top of the vehicle's roof. The width of the planar top surface would be approximately 4 feet.

A "half scale" system involves light vehicles, loads and smaller construction. Vehicles can be made small enough for 6 seated people. For example, a "half scale" vehicle may be 12 feet long, 5.5 feet wide and 6 feel tall. Several vehicles could be connected into trains. Size of the monorail structure could be sized down, too, so that the width of the planar top surface is approximately 30 inches. This size would have great applicability within industry, shopping centers, recreational and amusement, airports, fairs, and zoos.

For switching operations with the noted sizes of the "full scale" and "half scale" systems, the moveable end of the flexible stabilizer guide rail is displaced only a small amount between its first position and second position—180 centimeters for a "full-scale" vehicle and 115 centimeters for a small "half-scale" vehicle. The length of the flexible stabilizer guide rail will determine how fast each of these vehicle may go through the switch. For optimal high speed switching the flexible stabilizer guide rail should be longer than 75 feet.

Intermediate sized systems also could be built. In addition, a "half scale" vehicle could be adapted to run on the same monorail structure as a "full scale" vehicle as long as the bogie of the "half scale" vehicle can straddle and operate on the stabilizer guide rail normally used for "full scale" vehicles.

Thus the monorail system of the present invention has great flexibility in application. It can be used in a city environment where speed is reduced due to short distances between numerous stops or in rural areas where there are infrequent stops and speed may be as high as 300 miles per hour using the Maglev Technology embodiment. In addition, the small size of the monorail system of the present invention enables locating the monorail in a wide variety of urban and rural locations thereby reducing the physical and aesthetic impact on the environment.

Those skilled in the art will realize that the monorail system of the present invention will be one half to one third the cost of conventional elevated transportation systems. The reasons for the reduced cost is the small size of the components, reduced quantity of construction materials, and components can be mass produced in a factory and assembled in less time on site.

The invention may be embodied in other specific forms without departing from the spirit or central characteristics thereof. The present embodiments are therefore to be considered in all respects as illustrative and not restrictive, the scope of the invention being indicated by the appended claims rather than by the foregoing description, and all changes which come within the meaning and range of equivalency of the claims are therefore to be embraced therein.

What is claimed is:

1. A monorail system comprising:

a support having an essentially planar top surface;

a longitudinal stabilizer guide rail having a vertical web supporting an upwardly and outwardly extending head forming two stabilizer guide tracks, said stabilizer guide rail, mounted parallel to and on top of said planar top surface and dividing said planar top surface into two parallel vehicle running paths;

at least one propelled vehicle, received in said parallel vehicle running paths, said vehicle having a vehicle body and a bogie in connection with said vehicle running paths and said stabilizer guide rail, said bogie being able to rotate independently about a pivot point between said vehicle body and said bogie;

a plurality of conductive contact rails mounted on said vertical web of said stabilizer guide rail below said head and running parallel to each other and to said stabilizer guide rail;

at least one current collector mounted to the vehicle and having at least one collector head in electrical communication with said contact rails such that electrical power is transmitted through the contact rails to the vehicle;

means on said bogie for steering said vehicle by following said stabilizer guide rail; and means on said vehicle for receiving control commands and signals.

2. The monorail system of claim 1 wherein said bogie further includes;

a bogie frame;

one or more axles attached to said bogie frame and positioned substantially perpendicular to said parallel vehicle running paths;

a drive wheel assembly having one or more drive wheels connected to each said axle and adapted to run on said parallel vehicle running paths; and at least a pair of first and second guide wheels attached to said bogie frames said pair of guide wheels straddling said stabilizer guide rail, and each wheel of said pair of guide wheels attached through a linkage to said bogie frame and inclined to run along one stabilizer guide track.

3. The monorail system of claim 2, wherein one or more of said drive wheels and said guide wheels are selected from the group consisting of solid metals, alloys, rubber and synthetic rubber.

4. The monorail system of claim 2, wherein one or more of said drive wheels and said guide wheels are pneumatic tires.

5. The monorail system of claim 4, wherein one or more of said drive wheels and said guide wheels further include a rigid disk mounted adjacent to each said pneumatic tire in substantially the same running orientation as said pneumatic tire, said rigid disk having a slightly smaller diameter than said pneumatic tire.

6. The monorail system of claim 2, wherein one or more of said drive wheels and said guide wheels are rubber or synthetic rubber tires filled with foam.

7. The monorail system of claim 2, wherein said bogie includes at least one electrical traction motor with a drive arrangement for said drive wheels attached to said axle.

8. The monorail system of claim 2, wherein at least one of said drive wheels is propelled by an electrical traction motor fixed to the vehicle and in communication with said axle through a gear mechanism.

9. The monorail system of claim 2, wherein each said guide wheel linkage is independently mechanically biased to automatically adjust said inclined guide wheels to the upwardly and outwardly sloping side of said head of said stabilizer guide rail.

10. The monorail system of claim 2, wherein said top surface of said support includes a longitudinal beam having a width not more than half the width of said vehicle.

11. The monorail system of claim 10, wherein said longitudinal beam includes:

a plurality of longitudinal members, each longitudinal member having a first end, a second end, a top surface, and a width not more than half the width of said vehicle; and at least two said longitudinal members interconnected end-to-end to form a single beam.

12. The monorail system of claim 1, wherein said vehicle is propelled by at least one linear electric motor.

13. The monorail system of claim 2, farther including at least one linear electric motor mounted to said bogie, and said stabilizer wide rail includes a conductive element adjacent to said linear electric motor such that said vehicle may be propelled by said linear electric motor along said stabilizer guide rail.

14. The monorail system of claim 12, wherein said top surface of said support includes a longitudinal beam having a width not more than half the width of said vehicle.

15. The monorail system of claim 14, wherein said longitudinal beam includes:

a plurality of longitudinal members, each longitudinal member having a first end, a second end, a top surface, and a width not more than half the width of said vehicle, and at least two said longitudinal members interconnected end-to-end to form said beam.

16. The monorail system of claim 1, wherein said vehicle is levitated by at least one electro-magnetic levitation device.

17. The monorail system of claim 16, wherein said electro-magnetic levitation device includes:

a plurality of stationary levitating magnets received along said vehicle running paths;

a plurality of stationary stabilizing magnets received along said stabilizer guide tracks;

at least a first and second traveling levitating magnets received within said bogie frame positioned on opposite vertical sides of said stabilizer guide rail, each said levitating magnet aligned to interact with said stationary levitating magnets, said traveling levitating magnets oppositely charged from said stationary levitating magnets to create a repulsive force between said traveling levitating magnets and said stationary levitating magnets; and at least a first traveling guide magnet and a second traveling guide magnet positioned on opposite vertical sides of said stabilizer guide rail, each said guide magnet attached to said bogie frame and inclined to be positioned along one stabilizer guide track of said upwardly and outwardly extending head, said traveling guide magnets oppositely charged from said stationary guide magnets to create a repulsive force between said traveling guide magnets and said stationary guide magnets such that said vehicle may be levitated above said top surface.

18. The monorail system of claim 17, wherein said top surface of said support includes a longitudinal beam having a width not more than half the width of said vehicle.

19. The monorail system of claim 18, wherein said longitudinal beam includes:

a plurality of longitudinal members, each longitudinal member having a first end, a second end, a top surface, and a width not more than half the width of said vehicle, and at least two said longitudinal members interconnected end-to-end to form said beam.

20. The monorail system of claim 1, wherein:

said stabilizer guide rail is flexible throughout its length;

one end of a predetermined length of said flexible stabilizer guide rail connected to said means for support and flexed about said length forming a pathway switch;

at least a second means for support having said planar top surface and a second stabilizer guide rail with a second vertical web supporting an upwardly and outwardly extending head forming two stabilizer guide tracks, each said stabilizer guide rail mounted parallel to and on top of said planar top surface and dividing said planar top surface into two parallel vehicle running paths;

said pathway switch having at least a first position aligning said pathway switch in longitudinal alignment with said first stabilizer guide rail and at least a second position aligning said pathway switch in longitudinal alignment with said second stabilizer guide rail; and means for adjustably positioning said pathway switch at least to said first position and said second position.

21. The monorail system of claim 20, wherein said means for adjustably positioning includes:

at least one guide slot received within said means for support along said predetermined length and running essentially perpendicular to the distance traveled by said flexible stabilizer guide rail between said first and second position;

said pathway switch slidably attached to follow said guide slot;

a crank motor mounted to said means for support; and a lever arm assembly extending between said crank motor and said switch having a lever arm and an expandable arm forming an expandable longitudinal member, said lever arm directly secured to said crank motor such that rotation of said crank motor causes said longitudinal member to rotate permitting said switch to be mechanically manipulated along said guide slot between said first position and said second position.

22. The monorail system of claim 1 wherein said vehicle is levitated and propelled by an electro-magnetic propulsion and levitation device.

23. The monorail system of claim 1 wherein each of the contact rails has a conductive portion and an insulated portion; and said current collector is in electrical communication with each of the conductive portions of the contact rails.

24. The monorail system of claim 23, wherein the conductive portion of each of the contact rails has a generally c-shaped cross section defining an outer surface and an inner surface with the insulated portion covering the outer surface of the conductive portion.

25. The monorail system of claim 1, wherein said means for receiving control commands includes:

a plurality of conductive control conduits mounted on the web of the stabilizer guide rail below the head and running parallel to each other and to the stabilizer guide rail; and at least one communications connector mounted to the vehicle in electrical communication with the control conduits such that control commands and signals may be transferred through the conduits to the vehicle.

26. The monorail system of claim 25, wherein said web portion has opposite first and second sides with said contact rails mounted on said first side and said control conduits mounted on said second side.

27. The monorail system of claim 25, wherein each of said control conduits have a conductive portion and an insulated portion; and said communications collector is in electrical communication with each of said conductive portions of said control conduits.

28. The monorail system of claim 27, wherein the conductive portion of each of said control conduits has a c-shaped cross section defining an outer surface and an inner surface with said insulated portion covering said outer surface of the conductive portion.

29. The monorail system of claim 1, wherein said means for receiving control commands includes:

an antenna mounted on said vehicle; and a radio receiver received within said vehicle for receiving control commands and signals through radio waves.

30. The monorail system of claim 2, wherein each of said linkages operates independently of the other allowing for independent adjustment and service of each linkage.

31. A monorail for guiding and transmitting power to a vehicle through a current collector extending from the vehicle, said vehicle adapted to travel on an essentially planar top surface of a support of said monorail comprising:

a longitudinal stabilizer guide rail having a vertical web supporting an upwardly and outwardly extending head forming two stabilizer guide tracks, said rail mounted on top of the planar top surface of said support to form two parallel planar vehicle running paths on said top surface on which the vehicle travels; and a plurality of conductive contact rails mounted on said vertical web of said stabilizer guide rail below said head and running parallel to each other and to said stabilizer guide rail, said contact rails sized and shaped to electrically connect to the current collector.

32. The monorail of claim 31, wherein a portion of said longitudinal stabilizer guide rail is flexible between a first and second planar position forming a pathway switch; and further including:

means for adjustably positioning said switch between said first and second positions.

33. The monorail of claim 32, wherein said means for adjustably positioning includes:

a crank motor secured near the flexible portion of the longitudinal stabilizer; and a lever arm assembly mounted between said crank motor and said switch permitting said switch to be mechanically manipulated between said first and second positions.

34. The monorail of claim 31, wherein each of the contact rails has a conductive portion and an insulated portion; and the current collector is in electrical communication with each of the conductive portions of the contact rails.

35. The monorail system of claim 34, wherein the conductive portion of each of the contact rails has a generally c-shaped cross section defining an outer surface and an inner surface with the insulated portion covering the outer surface of the conductive portion.

36. The monorail system of claim 31, further including:

a plurality of conductive control conduits mounted on the web of the stabilizer guide rail below the head running parallel to each other and to the stabilizer guide rail; and at least one communications connector mounted to the vehicle in electrical communication with the control conduits such that control commands and signals may be transferred through the conduits to the vehicle.

37. The monorail system of claim 36, wherein said web portion has opposite first and second sides with said contact rails mounted on said first side and said control conduits mounted on said second side.

38. The monorail system of claim 36, wherein each of said control conduits have a conductive portion and an insulated portion; and said communications collector is in electrical communication with each of said conductive portions of said control conduits.

39. The monorail system of claim 38, wherein the conductive portion of each of said control conduits has a generally c-shaped cross section defining an outer surface and an inner surface with said insulated portion covering said outer surface of the conductive portion.

40. A monorail system comprising:

a support having an essentially planar top surface;

a longitudinal stabilizer guide rail having a vertical web with opposite first and second sides supporting an upwardly and outwardly extending head forming two stabilizer guide tracks, said stabilizer guide rail mounted parallel to and on top of said planar top surface and dividing said planar top surface into two parallel vehicle running paths;

at least one propelled vehicle, received in said parallel vehicle running paths, said vehicle having a vehicle body and a bogie in connection with said vehicle running paths and said stabilizer guide rail;

said bogie being able to rotate independently about a pivot point between said vehicle body and said bogie, and including;

a bogie frame;

one or more axles attached to said bogie frame and positioned substantially perpendicular to said parallel vehicle running paths;

a drive wheel assembly having one or more drive wheels connected to each said axle and adapted to run on said parallel vehicle running paths; and at least a pair of first and second guide wheels attached to said bogie frame, said pair of guide wheels straddling said stabilizer guide rail, and each wheel of said pair of guide wheels attached through a linkage to said bogie frame and inclined to run along one stabilizer guide track such that the vehicle is guided by the stabilizer guide rail;

a plurality of conductive contact rails mounted on said first side of said vertical web below said head and running parallel to each other and to said stabilizer guide rail, each said contact rail having a rail conductive portion and a rail insulated portion, said rail conductive portion having a generally c-shaped cross section defining an outer surface and an inner surface with the rail insulated portion covering the outer surface of the rail conductive portion;

at least one current collector mounted to the vehicle and having at least one collector head in electrical communication with said contact rails such that electrical power is transmitted through the insulated contact rails to the vehicle;

a plurality of conductive control conduits mounted on said second side of said web below the head and running parallel to each other and to the stabilizer guide rail, each said control conduit having a conduit conductive portion and a conduit insulated portion, said conduit conductive portion having a generally c-shaped cross section defining an outer surface and an inner surface with said conduit insulated portion covering said outer surface of the conduit conductive portion; and at least one communications connector mounted to the vehicle in electrical communication with the control conduits such that control commands and signals may be transferred through the conduits to the vehicle.

* * * * *